US005819495A

United States Patent [19]

Goodland

[11] Patent Number: 5,819,495

[45] Date of Patent: Oct. 13, 1998

[54] FASTENING DEVICE

[76] Inventor: Christopher Alan Goodland, Pymore Mills, Bridport, Dorset DT6 5JP, England

[21] Appl. No.: 736,258

[22] Filed: Oct. 24, 1996

[51] Int. Cl.[6] ..... E04B 1/38

[52] U.S. Cl. ..... 52/704; 52/295; 52/166; 403/20

[58] Field of Search ..... 52/295, 166, 162, 52/163, 164, 296, 297, 703, 704; 403/20, 376

[56] References Cited

U.S. PATENT DOCUMENTS

| | | | |
|---|---|---|---|
| 3,863,975 | 2/1975 | Oldenettel | 52/704 X |
| 4,633,627 | 1/1987 | Tucker | 52/166 X |
| 5,321,922 | 6/1994 | Popp et al. | 52/166 X |
| 5,384,993 | 1/1995 | Phillips | 52/295 X |
| 5,490,365 | 2/1996 | Roth | 52/704 |
| 5,537,794 | 7/1996 | Tolliver et al. | 52/704 X |

*Primary Examiner*—Creighton Smith
*Attorney, Agent, or Firm*—Kane, Dalsimer, Sullivan, Kurucz, Levy, Eisele and Richard

[57] ABSTRACT

A fastening device comprises a connecting member 8 and a body 1, an object to be secured typically being attached to the connecting member, and the body being installed, at a fixed location 25. To secure the object, an end 11 of the connecting member 8 must be inserted through an opening 6 in the body 1 for engagement with a retaining means after the retaining means has been temporarily moved away from its operative position. An actuating means 13, which may be hidden, is used for release of the object, and may require some skill for operation. Installation of the body 1 is described in relation to one embodiment of the invention.

18 Claims, 7 Drawing Sheets

FASTENING DEVICE

Figure 1:
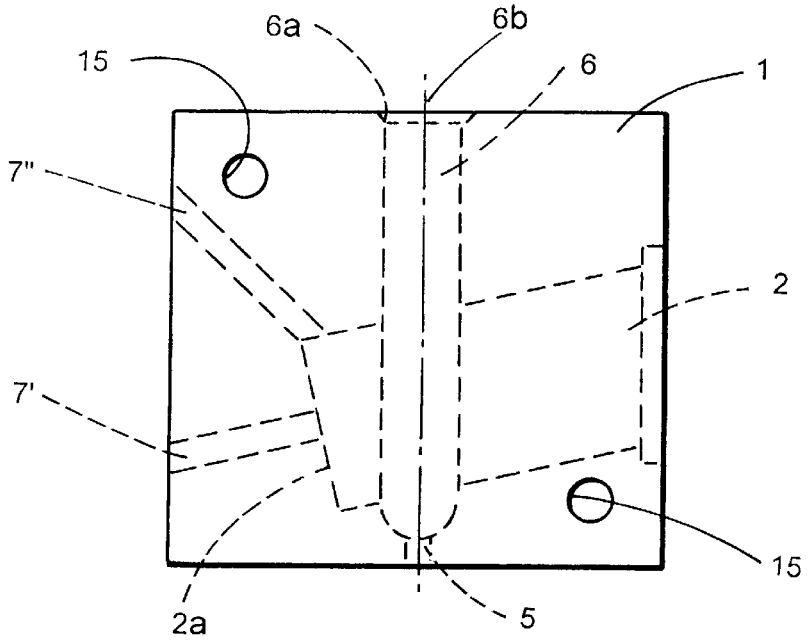

This invention relates to a fastening device, and particularly, but not exclusively, to a fastening device for resisting removal of objects by thieves or vandals.

Presently in the construction industry, for example, it is usual to secure objects in a concrete footing to prevent unauthorised removal. However, when it is desired to replace or repair the object, considerable time, resources and effort have to be used in removing the concrete.

According to a first aspect of the present invention, a fastening device comprises a connecting member, a body adapted to be fixedly anchored with respect to a permanent support and having a bore therein which is inclined to the vertical in the anchored position of the device, and retaining means movable downwardly along the bore, under the action of the weight of the retaining means, to an operative position in the bore in which the retaining means is engageable with the connecting member so as to prevent separation of the connecting member therefrom.

Typically an object to be secured is attached to the connecting member, the body having been firmly installed at a fixed location. For example, the body may be set in concrete in the ground, or in a brick or stone wall of a building.

In preferred embodiments of the invention, actuating means is provided for moving the retaining means away from its operative position to enable separation of the connecting member therefrom. The actuating means may comprise a removable actuating member.

After engagement between the retaining means and the connecting member, subsequent operation of the actuating means by an authorised person will enable the object to be removed from the fixed location with minimum difficulty.

In addition to use in the construction industry for securing an item to the ground or to a wall, an example of a further use of the invention is for preventing unauthorised removal of valuable goods from shops.

Still another use is for securing valuable or vulnerable garden ornaments or furniture.

The connecting member may have an upper end in the form of an inverted U for securing the wheel of a bicycle of motorbike by engagement with the wheel rim.

The body of the device is desirably provided with an opening which intersects with the bore so as to enable the connecting member to be inserted within the body for engagement with the retaining means.

The device may be conveniently provided with displacing means for moving the retaining means away from its operative position during insertion of the connecting member, but allowing the retaining means to return to the operative position under the action of the weight of the retaining means to engage the connecting member after insertion.

The displacing means conveniently comprises a camming surface on the connecting member. Alternatively the displacing means may comprise said actuating means.

In a preferred embodiment of the invention, the connecting member comprises balking means for urging the retaining means against a stop to ensure that the retaining means remains in the operative position when an attempt is made to remove the connecting member from engagement with the retaining means.

The stop may conveniently comprise an end wall of the bore.

Alternatively or in addition to said balking means the wall of the bore may be so shaped as to urge the retaining means against the stop when an attempt is made to remove the connecting member from the body. Furthermore, the connecting member may desirably be adjustable after engagement with the retaining means for example using screw-threaded means, so as to tighten the engagement between the connecting member and the retaining means.

The retaining means desirably comprises a ball.

The connecting member preferably comprises a ring or a hook for engagement with the retaining means, an outwardly directed surface of the ring or the hook conveniently comprising said camming surface of the displacing means, with an inwardly directed surface of the ring or the hook also comprising a further camming surface to form said balking means.

The actuating means preferably comprises a striking member which is operated, either manually or by other means such as electrically driven solenoid means, to strike the retaining means so as to move the retaining means away from said operative position.

The device may be configured such that a certain level of skill is required by a person in order to coordinate the operation of the actuating means and removal of the connecting member, before the retaining means returns to its operative position. This could help to reduce unauthorised removal of the connecting member.

Operation of the actuating means may desirably be adjustable.

The body of the device may conveniently comprise a plastics moulding. For use in an exposed location, the body is preferably provided with a drainage channel to prevent the bore filling with water. To resist ingress of water and solids, the outer end of the bore is preferably provided with a cover.

According to a second aspect of the invention, a method of installing the body of the device at a fixed location in the ground comprises forming a hole in the ground to receive a concrete footing, placing the body in the hole together with a channel means extending above the body, and casting the footing around the body and the channel means whereby the channel means remains open to allow subsequent insertion of the connecting member down the channel means and into the body.

A control link is preferably also provided between the body and the surface of the ground, or between the body and a position near to but beneath the surface of the ground, to enable the actuating means to be operated from that position. It may be necessary to remove some surface material to locate said position.

Figure 4:
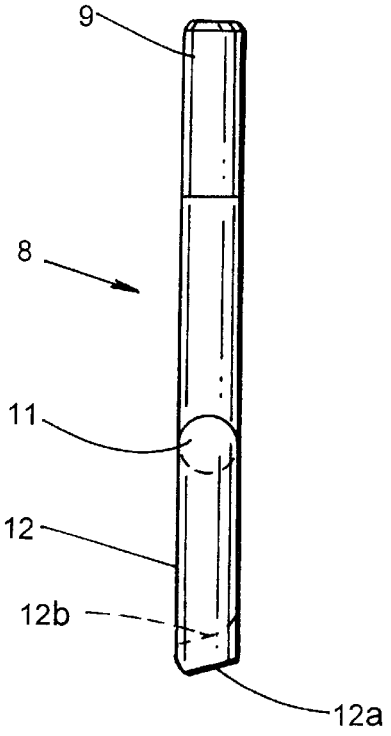
Figure 5:
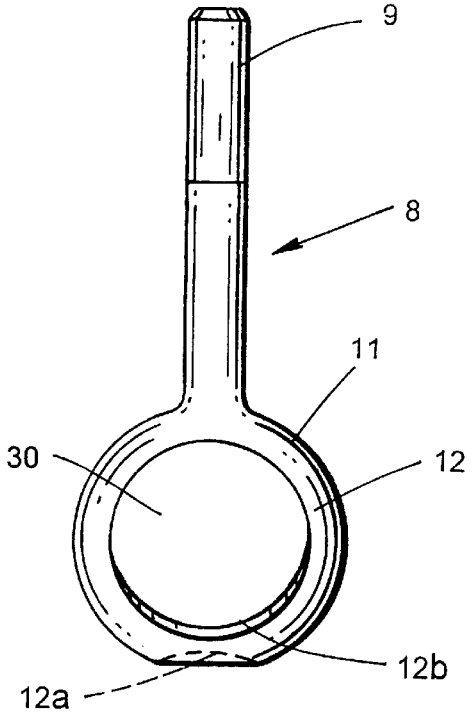
Figure 2:
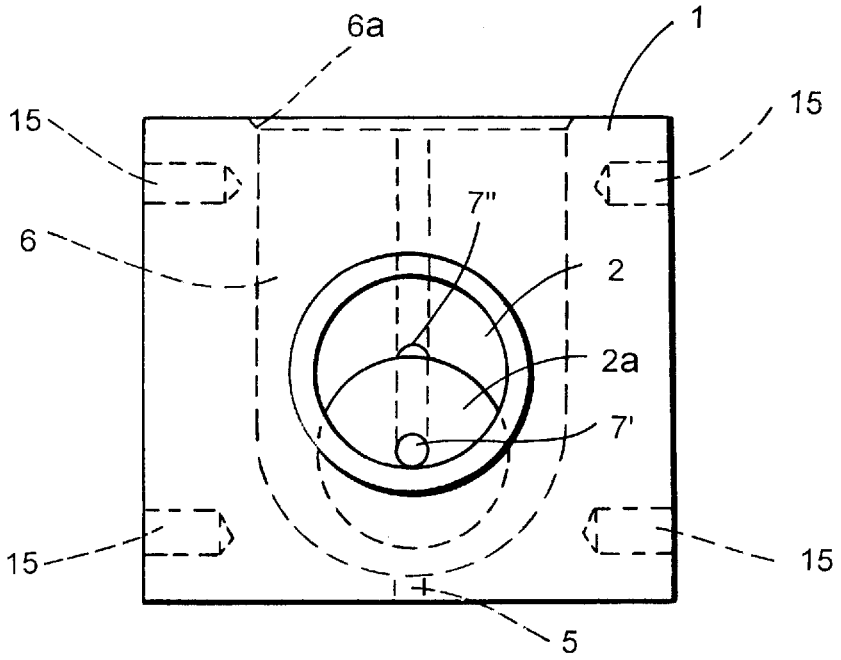
Figure 3:
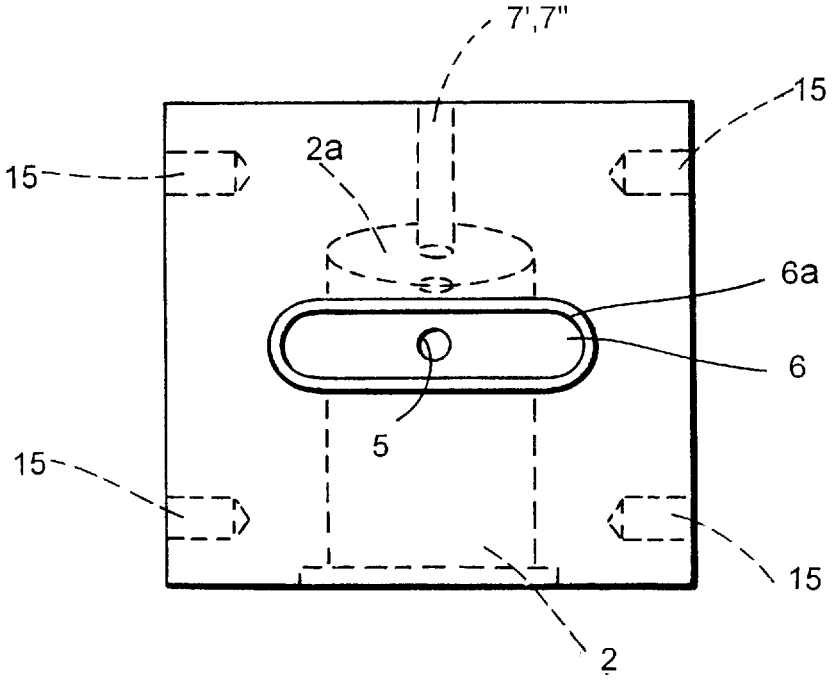
Figure 6:
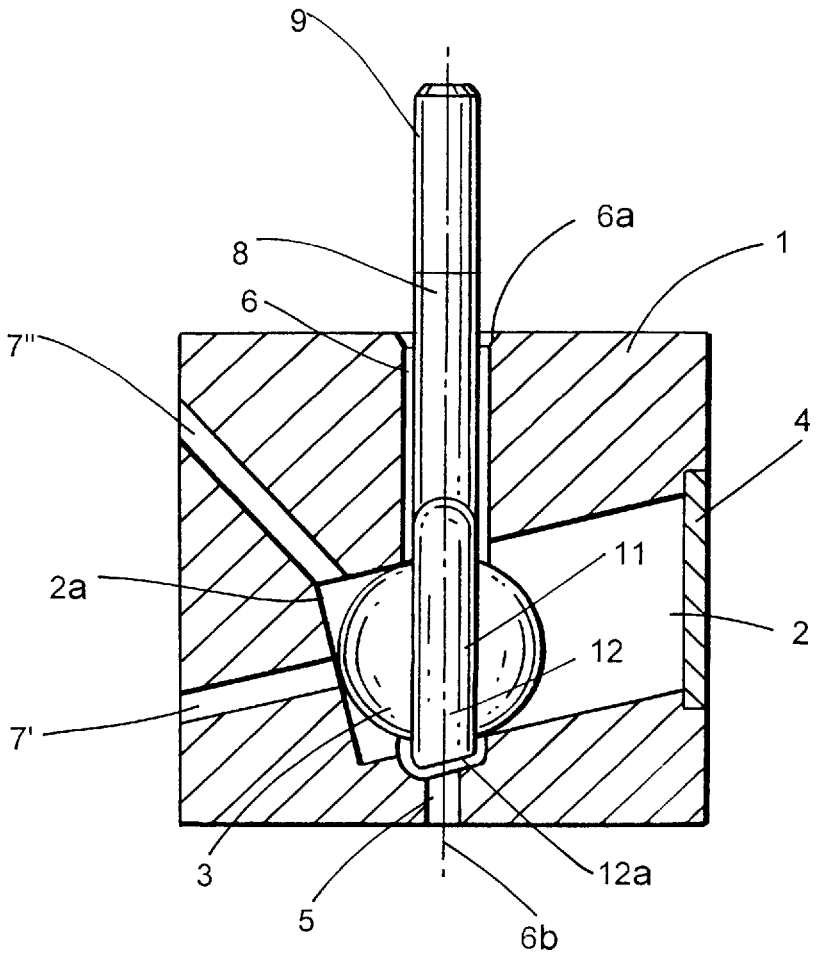
Figure 7:
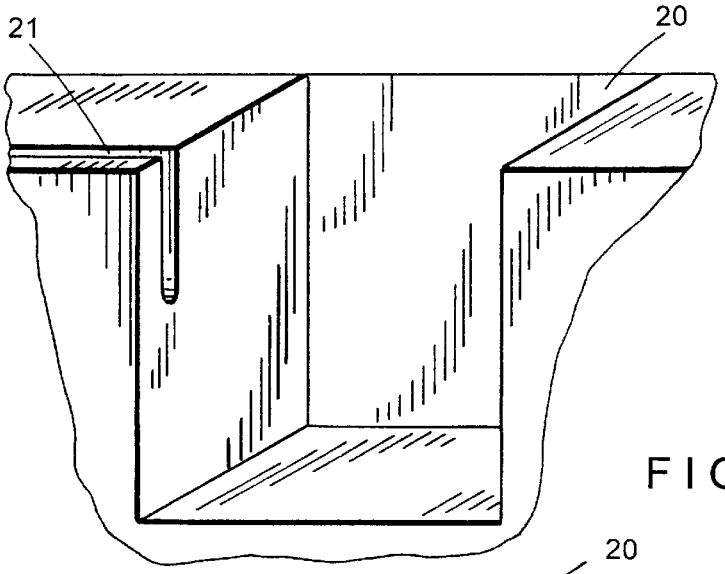
Figure 8:
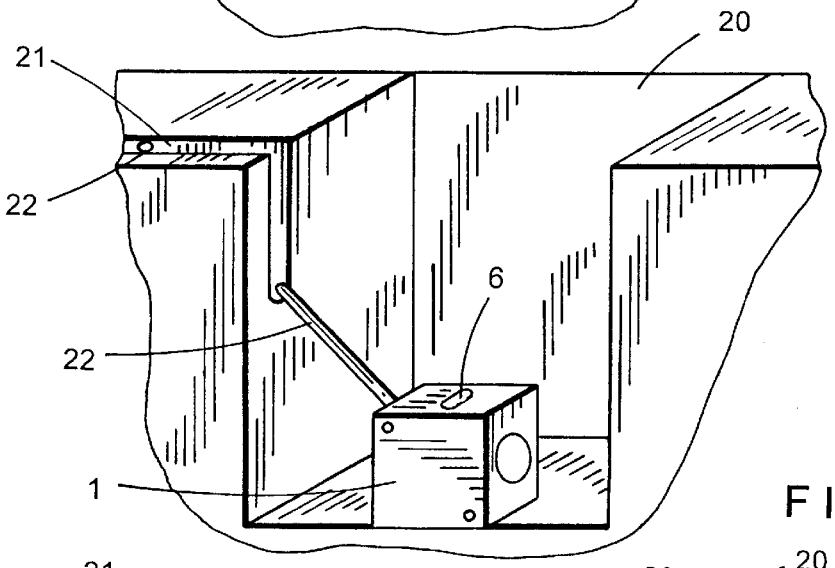
Figure 9:
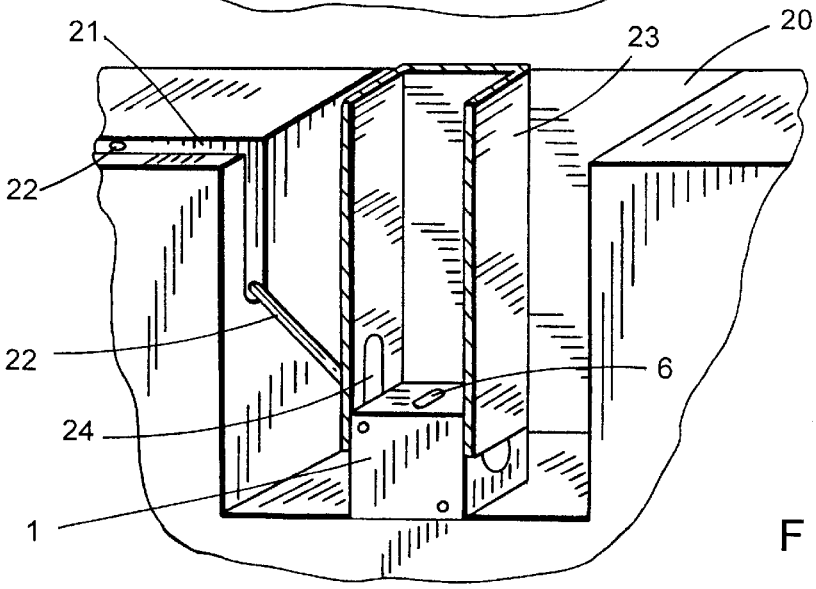
Figure 10:
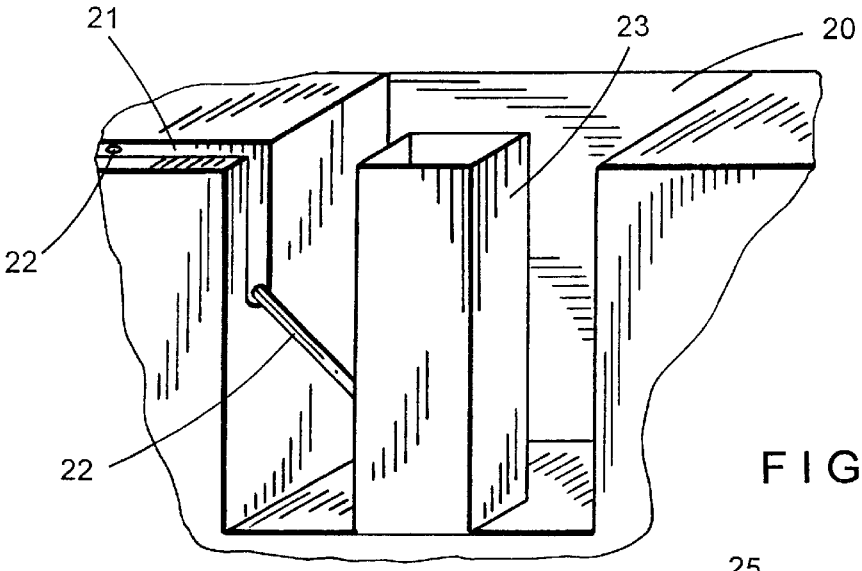
Figure 11:
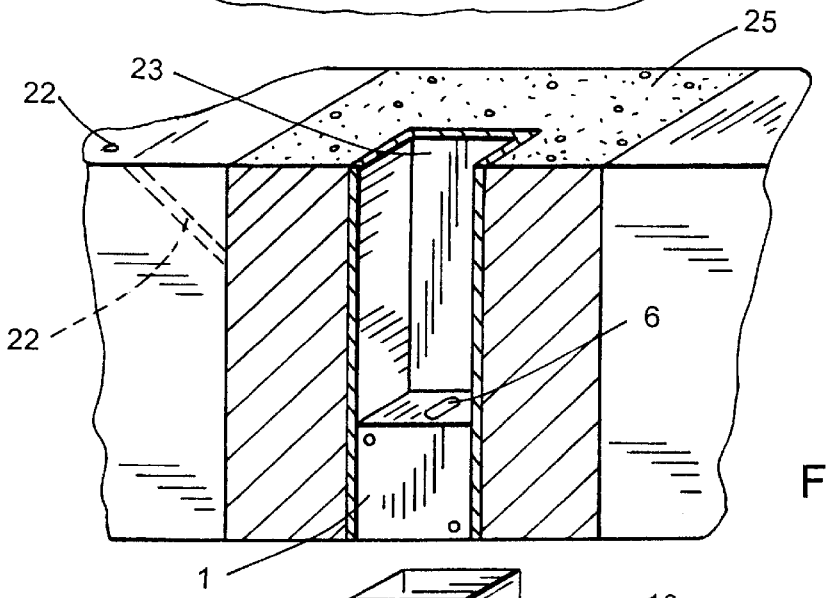
Figure 12:
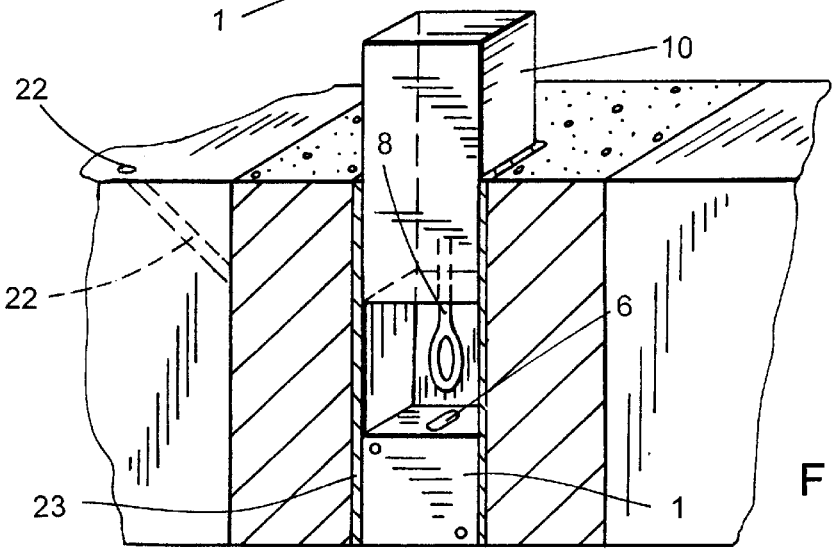
Figure 13:
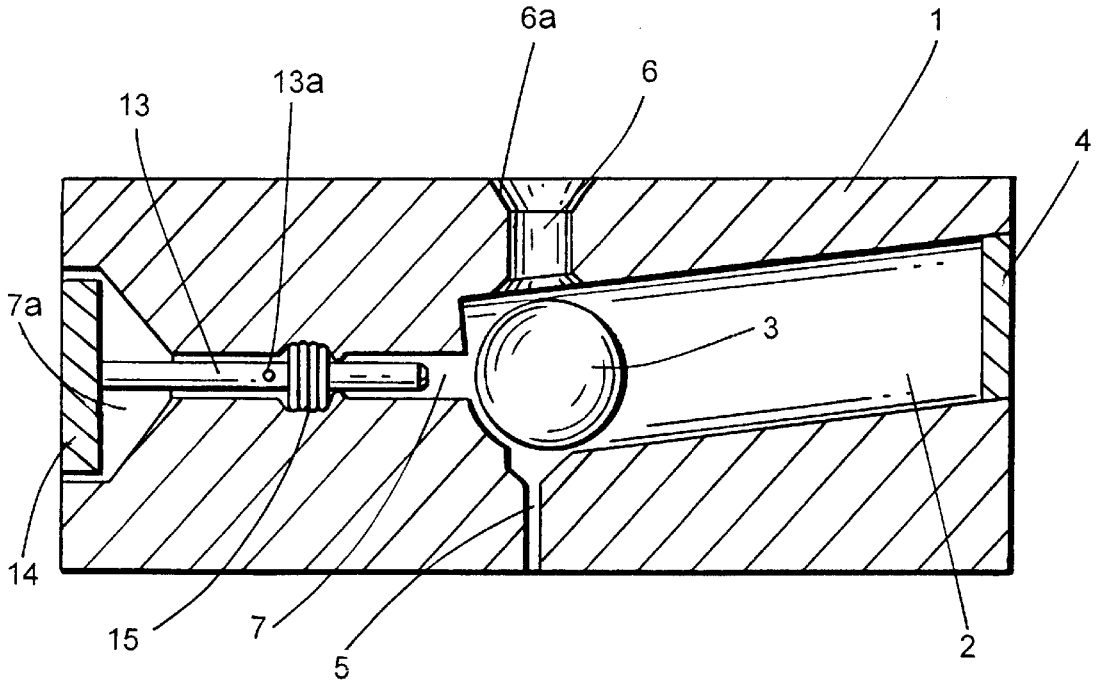
Figure 14:
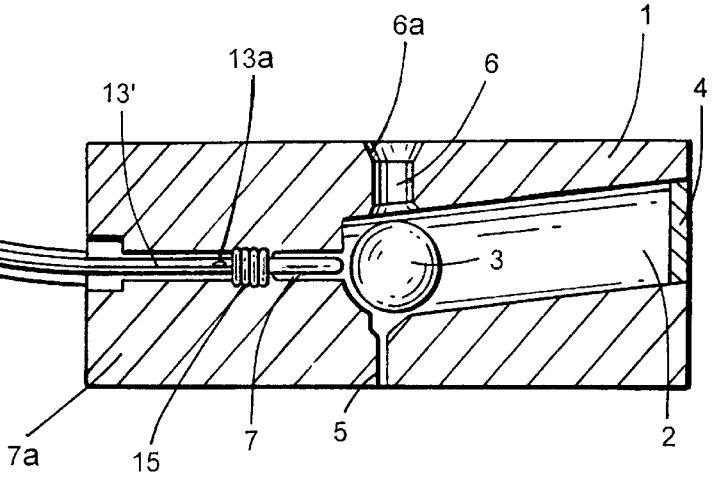
Figure 15:
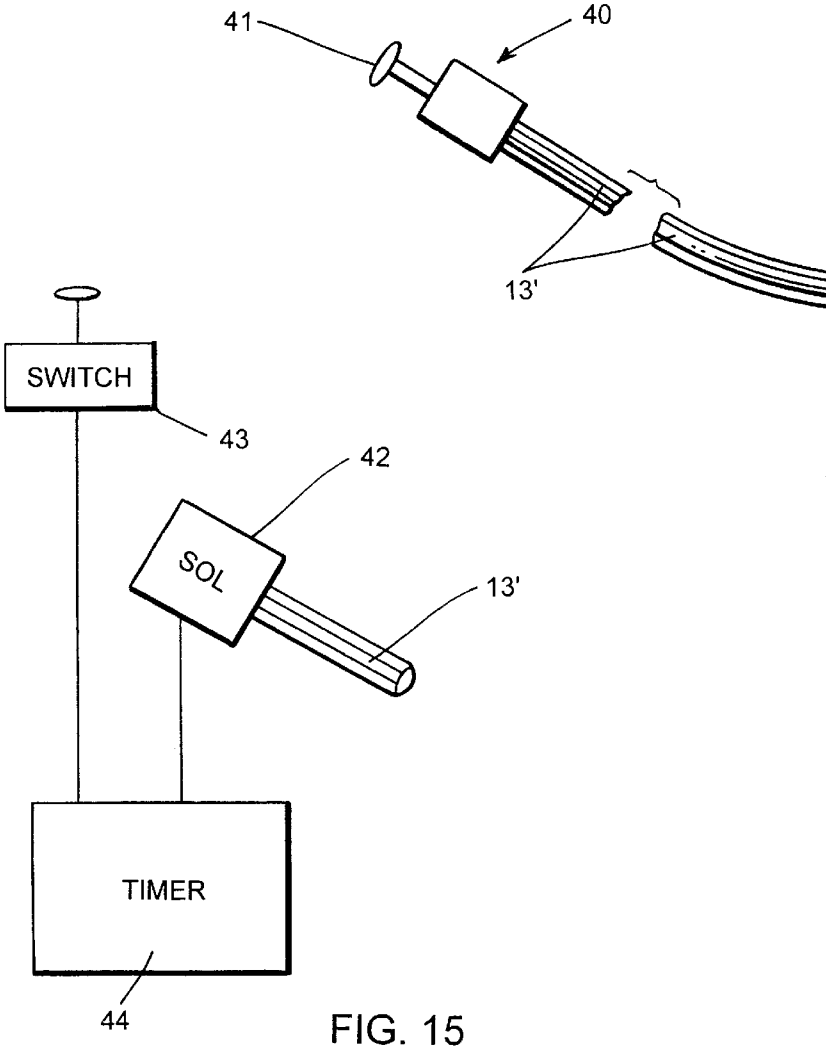

By way of example only, preferred embodiments of the invention will now be described with reference to the accompanying drawings, in which:

FIG. 1 is a side view of the body of the device in a first embodiment of the invention, FIG. 2 is a front view of the body in FIG. 1, FIG. 3 is a plan view of the body in FIG. 1, FIG. 4 is a side view of the connecting member of the device in the first embodiment, FIG. 5 is a rear view of the connecting member of FIG. 4, FIG. 6 is a side view in section showing an assembly of the device in the first embodiment, FIG. 7 is a partially sectioned view showing the first stage in installing the body of the device, FIG. 8 is a partially sectioned view showing the second stage in installing the body of the device, FIG. 9 is a partially sectioned view showing the third stage in installing the body of the device, FIG. 10 is a partially sectioned view showing the fourth stage in installing the body of the device, FIG. 11 is a partially sectioned view showing the fifth stage in installing the body of the device, FIG. 12 is a partially sectioned view showing the sixth stage in installing the body of the device, FIG. 13 is a side view in section showing an assembly of the device in a second embodiment, without the connecting member being in place, FIG. 14 is a view similar to FIG. 13 of a modification employing a cable-operated actuating means, and FIG. 15 is a schematic view of the remote end of a solenoid-cable operated actuating means.

Referring first to FIGS. 1, 2, 3 and 6, a fastening device is illustrated thereby. The device comprises, in interchangeable combination, an anchorage body 1, an elongate member 8 having an outer or upper end 9 and an inner or lower end 11. The lower end 11 is insertable into the body 1; a retaining ball 3 of stainless steel is disposed within the body and is operable to lock the elongate member 8 to the body 1. The body 1 comprises a plastics moulding in the form of a cubic block 1 having a downwardly inclined main bore 2 which locates the stainless steel ball 3. The outer end of the bore 2 is sealed by a cover 4 to prevent the ball 3 dropping out prior to installation of the block in the ground, and to prevent the ingress of water and solids through the outer end after installation. However, in case water should enter by any other opening, a drainage outlet 5 is provided towards the lower end of the bore 2. An opening in the form of a slot 6 extends downwardly between the bore 2 and the upper face of the block 1, the slot 6 intersecting both the bore 2 and the drainage outlet 5. The slot 6 provides access to the bore 2 for the elongate connecting member 8 shown in FIGS. 4, 5 and 6. The rim of the mouth of the slot 6 at the upper surface of the block 1 is provided with a chamfer 6*a* to facilitate insertion of the connecting member 8 in use.

Coaxial with the main bore 2 is a ball-activating relatively small further bore 7' which connects main bore 2 with the outside and provides access for a striker member in the form of a pin such as pin 131 (see FIG. 13 ). Co-planar with bore 7', but at an angle of about 60° thereto, is an alternative bore 7' of similar small diameter to that of further bore 71'. Bore 71' provides access for a striker member in an alternative arrangement of the device.

Screw holes 15 may be provided in the sides of the block 1 for use in installation, as described hereinafter.

Referring now to FIGS. 4 and 5, the upper or outer end of the elongate connecting member 8 in this embodiment comprises a threaded portion 9 which may be screwed into the object to be secured (such as a post 10, the lower end of which is illustrated in FIG. 12) in order to join the object to the connecting member 8 prior to use of the device. Also prior to use of the device, the block 1 will have been fixedly anchored in the ground as described hereinafter.

The lower or inner end 11 of the elongate connecting member 8 comprises a ring 12, having an aperture 30. The function of the ring 12 will now be described with reference to FIG. 6.

When it is desired to secure the object, the lower end 11 of the connecting member 8 is inserted downwardly into the slot 6 of block 1, until ring 12 is locked by ball 3 in the position shown in FIG. 6. In doing this, the ball 3 must be displaced upwardly along the bore 2 from the operative position shown in FIG. 6, in order to allow the lower part of the ring 12 of the connecting member 8 to pass across the bore 2 to the final position shown in FIG. 6. This displacement is achieved by provision of displacing means in the form of a camming surface 12*a* forming a lower, outwardly directed surface of the ring 12. The direction of insertion of the connecting member 8 is defined by the axis 6*b* of the slot 6, and camming surface 12*a* is angled with respect to axis 6*b* as shown in FIG. 6, whereby the elongate member 8 is prevented from being withdrawn from the block 1 by interengaging contact between the ball 3 and the block 1 such that ball 3 is deflected upwardly along bore 2 when camming surface 12*a* engages with the ball 3 during insertion. Only when the ring has reached the position shown in FIG. 6 is the ball 3 free to roll into the aperture of the ring 12 back to its starting position, thus achieving the locked or operative condition illustrated in FIG. 6.

If an improper attempt is now made to withdraw the connecting member 8, engagement between the ball and a lower, inwardly directed further camming surface 12*b* of the ring 12 ensures that the ball is wedged against a stop comprised by the lower end wall 2*a* of the bore 2, such that the ball is forced to remain inside the ring 12 as illustrated in FIG. 6, so preventing the connecting member 8 from being removed.

In order to achieve authorised removal of the connecting member 8 from block 1, a striking member, which can be as shown in FIG. 13, located in either bore 7' or 7" must be operated to strike the ball 3 and drive it upwardly along bore 2 towards the cover 4. The brief interval during which the ball remains in the upper portion of the bore 2 is sufficient to enable the connecting member 8 to be lifted to a position in which the ball can no longer pass back through the ring to lock it in position. The connecting member 8 can then be removed fully from the block 1 so that the object attached to the connecting member 8 can be taken away. The striking member may be operated by manual, electrical or other actuating means.

Manual actuating means are utilised in the second embodiment as shown in FIG. 13 in a view which corresponds generally to the view of the first embodiment shown in FIG. 6. Like reference numerals have been used for like parts in FIGS. 6 and 13.

In FIG. 13 the ball-striking member, which is in the form of an activator pin, is indicated by reference 13. The striking member 13 is housed in bore 7, and the enlarged opening 7*a* of the bore 7 is covered by a flexible plate 14. If the centre of plate 14 is hit, for example with the foot, it will distort within enlarged opening 7*a* so as to project striking member 13 forwardly against ball 3, so driving the ball 3 up the inclined bore 2 towards cover 4. Return of striking member 13 from its forward position to the position shown in FIG. 13 is achieved by the action of a return spring 15 on a lug 13*a* on the striking member 13.

In order to withdraw the connecting member 8 after hitting plate 14 and before ball 3 has returned to its former position, a basic level of skill is required to co-ordinate hitting of plate 14 and withdrawal of connecting member 8. This is advantageous in preventing unauthorised removal by a person who is not aware of the need to apply such skill.

The actuating means need not be in the form of a striking member that applies a momentary impact to the ball. Instead, a cable operation is possible. FIG. 14 shows a cable-operated actuating means.

In FIG. 14 parts corresponding to those of the assembly of FIG. 13 have been given corresponding reference numerals. In this embodiment the pin 13' comprises the inner cable of a co-axial cable which can be operated remotely by a hand-operated device 40, illustrated schematically. Device 40 can be any well-known cable-operating mechanism but desirably includes a latch or holding-clutch mechanism of well-known construction so arranged that on depression of plunger 41 to unseat ball 3, the inner cable 13' is held in the projected position by the device 40 until the plunger is operated again, or a latch is released. This enables the device 40 to be positioned in a concealed position remote from the connecting member 8. For example, the device 40 could be hidden in a flower-bed nearby, the location of which is known only to authorised users. The authorised user would then operate the plunger 41 to unseat the ball 3, he would then go to the connecting member 8 and remove that from the body 1 so as to release whatever is connected to the member 8, and he would then return to the device 40 to retract the plunger 41. The ball 3 returns to the operative position, shown in FIG. 14, so as to be ready for re-insertion and locking of the connecting member.

The device 40 could incorporate a mechanical timing mechanism, for example a mechanism utilising a dash pot, whereby the plunger 41 returns to the de-activated position after a timed period.

FIG. 15 shows schematically a modified cable-operating means suitable for use with the fastening device of FIG. 14 in which the cable 13' is operated by a solenoid device 42 in response to manual operation of switch 43. An electronic timer 44 times the current to solenoid 42 to provide a timed period in which the ball 3 is unseated, to enable the connecting member 8 to be removed from body 1 during the timed period. The timed period is set to be sufficient to enable the user to walk from the switch 43 to the connecting member 8 and remove the connecting member 8 before the solenoid 42 is de-activated.

Installation of the block I of the first embodiment for securing a post 10 (see FIG. 12) will now be described with reference to FIGS. 9 to 12.

The first stage in the installation is to dig a hole 20 in the ground to receive a concrete footing. The hole is illustrated diagrammatically in FIG. 7 with the front wall cut away for clarity. The hole 20 is extended to one side by a slot 21, the base of which runs at approximately 45° to the horizontal.

The second stage, shown in FIG. 8, is to place the block 1 approximately centrally at the base of the hole, and to ensure that it is level, with the opening of slot 6 in the block facing upwards. Next a control link 22 is positioned so that it extends from an attachment with the opening to bore 7" on the block 1 to the surface of the ground, or near to the surface of the ground, along slot 21.

The next stage in the installation, illustrated in FIG. 9, is to place a channel member 23 over the block. The front wall of channel member 23 is shown cut away in the drawing for clarity, but is in fact a tubular member of square cross-section, which is apparent in FIG. 10. A slot 24 is provided one side wall of the channel member 23, extending from the lower edge thereof, in order to allow the channel member to pass over the control link 22. In the embodiment shown, the channel member may be joined to the body 1 using screws fastened in holes 15 in the body. However, the channel member may be joined to the body in other ways.

For example the channel member and body may be formed to snap-fit together.

The final stage in installation of the block 1 is to cast the concrete footing 25 around channel member 23 and the communication link 22, as shown in FIG. 11, and to cover slot 21 for the communication link, or to fill it with earth, concrete or other suitable material according to requirements. For example, if it is desired for the communication link to project permanently above the ground, it may be held in place by pouring concrete into slot 21.

Alternatively, it may be desirable for the end of the communication link to be hidden below the surface of the ground, so that it can be operated only by persons aware of its location. In this case, the communication link could be covered with earth, the earth being used to fill the slot 21.

When the concrete has set, the device is ready for use. To secure a post of square section as shown in FIG. 10, for example, the connecting member 8 is fastened centrally in the lower end of the post, with the ring 12 of the connecting member oriented transversely. The end of the post can then be lowered into channel member 23 so that ring 12 enters the slot 6 in block 1 and becomes locked in position by the ball 3. The post can only be removed thereafter by use of control link 22 to operate the striking member located in bore 7" of the block 1.

Another application of the invention is to provide the releasable connection or hitch between an automobile and a trailer such as a mobile home. It will be appreciated that the body 1 could then be fixedly secured to the automobile or trailer by suitable permanent fasteners or welds. The body 1 would be provided with a horizontally directed opening 6 to receive the connecting member 8 which would be connected to the trailer or automobile respectively. In such a device the cover 4 could be replaced by a plug which engages with the ball 3 to prevent the ball from rolling up the inclined bore 2 due to vehicle movements. The plug may be threadedly engaged with the wall of bore 2, or be a push fit in the bore.

The plug outer end may be configured to require special tools to remove it.

I claim:

1. A fastening device comprising, in interchangeable combination:

a) an anchorage body (1);

b) an elongate member (8) having an outer end (9) and a lower end (11), the lower end (11) being insertable into the body (1); and c) a retaining ball (3) disposed within the body (1), the retaining ball (3) being operable to lock the elongate member (8) to the body (1), wherein the body (1) defines an downwardly inclined internal bore (2) having an inner end, wherein the body (1) also defines an opening (6); and d) an aperture (30) defined by the lower end (11) of the elongate member (8), the ball being downwardly movable under its own weight along the inclined internal bore (2), to penetrate and interengage with the aperture (30) whereby the elongate member (8) is then prevented from being withdrawn from the body (1) by the ball (3) and the body (1) being interengaged.

2. A device according to claim 1 further comprising:

a) an actuating means b) an actuating means bore (7) formed in the body (1) wherein the bore (7) is directed towards the aperture (30); and c) a ball actuator (13) received by the actuating means bore (7) whereby the actuator (13) is movable so as to displace the ball (3) away from its interengaging position with the aperture (30).

3. A device according to claim 2, wherein the actuator (13) comprises a ball-striking member having an inner end and an outer end.

4. A device according to claim 3, wherein the actuating means bore (7) has an outer end, covered by a flexible plate (14) having a central region and an outer region, the outer region being fixed to the body, the outer region of the ball-striking member (13) being positioned adjacent the central region of the plate (14), whereby when the central region is struck by an external impact source, the plate (14) flexes to cause the impact to be transmitted to the striking member (13) whereby the striking member (13) hits the ball (3) so as to displace the ball upwardly along the internal bore (2).

5. A device according to claim 2 further comprising a solenoid means (42) operable to move the actuator (13) so as to displace the ball (3) away from the interengaging position.

6. A device according to claim 5 further comprising a timing means operable to restrict the use of the solenoid means (42) during periods of time.

7. A device according to claim 1 further comprising a link means (13') connected to the actuating means, wherein the link means (13') extends to a location remote from the device at which the link means is operable to displace the ball from the aperture (30) at the lower end (11) of the elongate member (8).

8. A device according to claim 7 wherein the link means comprises a coaxial cable.

9. A device according to claim 1 further comprising displacing means (12*a*).

10. A device according to claim 9 wherein the displacing means comprises a camming surface formed on the lower end (11) of the elongate member.

11. A device according to claim 1 wherein the elongate member comprises means (12*b*) for urging the ball (3) against an internal stop (2*a*) defined by the inclined bore (2) whereby the ball (3) remains in its interengaging position with the elongate member (8).

12. A device according to claim 11 wherein the internal stop comprises a wall at the inner end of the inclined bore (2).

13. A device according to claim 1 wherein the body (1) comprises a plastics molding.

14. A device according to claim 1 wherein the body (1) comprises a water drainage outlet (3) from the internal bore (2).

15. A device according to claim 1 further comprising:

a) external, body-fixing surfaces (15) and b) a concrete cast around the external, body-fixing surfaces wherein the device is anchored in the ground by the concrete cast.

16. A method of installing at a fixed location in the ground the body (1) of the device according to claim 20, comprising forming a hole (20) in the ground to receive a concrete footing, placing the body (1) in the hole (20) together with a channel means (10) extending upwardly above the body (1) from said opening (6), and casting the footing around the body (1) and the channel means (10) such that the channel means remains open to allow insertion of the elongate member into said body.

17. A method according to claim 16, in which the device is provided with an actuator comprising a ball-striking member (13) having an inner end and an outer end provided with a control link (13'), said link extending between the body and the surface of the ground.

18. A method according to claim 16, in which the device is provided with an actuator comprising a ball-striking member (13) having an inner end and an outer end provided with a control link (13'), which is disposed between the body and a point near but beneath the surface of the ground.

* * * * *